US008737649B2

(12) United States Patent
Parker et al.

(10) Patent No.: US 8,737,649 B2
(45) Date of Patent: May 27, 2014

(54) BONE CONDUCTION DEVICE WITH A USER INTERFACE

(75) Inventors: John Parker, Roseville (AU); Christoph Kissling, Liebfeld (CH); Christian Peclat, Neuchatel (CH)

(73) Assignee: Cochlear Limited, Macquarie University, NSW (AU)

( * ) Notice: Subject to any disclaimer, the term of this patent is extended or adjusted under 35 U.S.C. 154(b) by 771 days.

(21) Appl. No.: 12/355,380

(22) Filed: Jan. 16, 2009

(65) Prior Publication Data

US 2009/0310804 A1 Dec. 17, 2009

Related U.S. Application Data

(60) Provisional application No. 61/041,185, filed on Mar. 31, 2008.

(51) Int. Cl.
*H04R 25/00* (2006.01)

(52) U.S. Cl.
USPC ..... 381/314; 381/151; 381/312; 381/326; 381/380

(58) Field of Classification Search
USPC ..... 381/151, 314, 312, 326, 380
See application file for complete search history.

(56) References Cited

U.S. PATENT DOCUMENTS 4,612,915 A 9/1986 Hough et al.
5,015,224 A * 5/1991 Maniglia ..... 600/25
5,604,812 A * 2/1997 Meyer ..... 381/314
5,735,790 A 4/1998 Håkansson et al.
5,913,815 A * 6/1999 Ball et al. ..... 600/25
5,935,170 A * 8/1999 Håkansson et al. ..... 600/25
6,115,477 A * 9/2000 Filo et al. ..... 381/151
6,415,034 B1 * 7/2002 Hietanen ..... 381/71.6

(Continued)

FOREIGN PATENT DOCUMENTS

DE 2451977 5/1975
EP 0340594 11/1989

(Continued)

OTHER PUBLICATIONS

Vermiglio et al. "A Measurement of Sound Level Perception when using the Bone-Anchored Hearing Aid (BAHA) for Trans-Cranial Stimulation of Individuals with Single-Sided Deafness" House Ear Institute. Advanced Hearing Science, International Hearing Aid Research Conference, Aug. 2004, Lake Tahoe, CA.

(Continued)

*Primary Examiner* — Fernando L Toledo
*Assistant Examiner* — Mohammed Shamsuzzaman

(57) ABSTRACT

The present invention relates to a bone conduction device for enhancing a recipient's hearing. The device may include an input configured to receive sound signals and generate a plurality of signals representative of the sound signals, an electronics module configured to receive the plurality of signals and having a first control setting configured to control a first characteristic of at least one of the plurality of signals and a second control setting configured to control a second characteristic of the at least one of the plurality of signals, a vibrator configured to receive the plurality of signals representative of the sound signals and transmit vibrations to the recipient's bone, and a user interface having a first interface control configured to interface with the first control setting and alter the first characteristic and a second interface control configured to interface with the second control setting and alter the second characteristic.

24 Claims, 10 Drawing Sheets

(56) References Cited

U.S. PATENT DOCUMENTS

| | | | | |
|---|---|---|---|---|
| 6,475,134 | B1 * | 11/2002 | Ball et al. | 600/25 |
| 6,560,468 | B1 * | 5/2003 | Boesen | 455/569.1 |
| 6,751,334 | B2 | 6/2004 | Hakansson | |
| 7,043,040 | B2 | 5/2006 | Westerkull | |
| 8,170,677 | B2 * | 5/2012 | Chambers et al. | 607/55 |
| 2002/0122563 | A1 | 9/2002 | Schumaier | |
| 2004/0234091 | A1 * | 11/2004 | Westerkull | 381/328 |
| 2005/0147267 | A1 * | 7/2005 | Gudmundsen et al. | 381/328 |
| 2005/0201574 | A1 * | 9/2005 | Lenhardt | 381/151 |
| 2005/0226446 | A1 | 10/2005 | Luo et al. | |
| 2006/0018488 | A1 * | 1/2006 | Viala et al. | 381/74 |
| 2006/0126874 | A1 * | 6/2006 | Westerkull | 381/326 |
| 2006/0239468 | A1 * | 10/2006 | Desloge | 381/60 |
| 2007/0195979 | A1 | 8/2007 | Thomasson et al. | |
| 2007/0249889 | A1 * | 10/2007 | Hanson et al. | 600/25 |
| 2009/0161892 | A1 * | 6/2009 | Servello et al. | 381/151 |
| 2010/0002887 | A1 * | 1/2010 | Roeck et al. | 381/23.1 |
| 2010/0098269 | A1 | 4/2010 | Abolfathi et al. | |
| 2010/0202637 | A1 * | 8/2010 | Cornelisse et al. | 381/314 |
| 2011/0158443 | A1 * | 6/2011 | Asnes et al. | 381/326 |
| 2012/0034873 | A1 * | 2/2012 | Boesen | 455/41.3 |

FOREIGN PATENT DOCUMENTS

| | | | |
|---|---|---|---|
| WO | 0193634 | A1 | 12/2001 |
| WO | 03/001845 | A1 | 1/2003 |
| WO | 2004/013977 | | 2/2004 |
| WO | 2007/023192 | | 3/2007 |

OTHER PUBLICATIONS

International Search Report; International Application No. PCT/AU2009/000366 mailed Aug. 13, 2009 (3 pages).

Extended European Search Report, European Application No. 09728833.6 mailed Apr. 1, 2011 (6 pages).

Baha Intenso Data sheet, E80727, Mar. 2007 (2 pages).

* cited by examiner

BONE CONDUCTION DEVICE WITH A USER INTERFACE

CROSS-REFERENCE TO RELATED APPLICATIONS

The present application claims the benefit of U.S. Provisional Patent Application 61/041,185; filed Mar. 31, 2008, which is hereby incorporated by reference herein.

BACKGROUND

1. Field of the Invention

The present invention is generally directed to a bone conduction device, and more particularly, to a bone conduction device having an advanced user interface.

2. Related Art

Hearing loss, which may be due to many different causes, is generally of two types, conductive or sensorineural. In many people who are profoundly deaf, the reason for their deafness is sensorineural hearing loss. This type of hearing loss is due to the absence or destruction of the hair cells in the cochlea which transduce acoustic signals into nerve impulses. Various prosthetic hearing implants have been developed to provide individuals who suffer from sensorineural hearing loss with the ability to perceive sound. One such prosthetic hearing implant is referred to as a cochlear implant. Cochlear implants use an electrode array implanted in the cochlea of a recipient to provide an electrical stimulus directly to the cochlea nerve, thereby causing a hearing sensation.

Conductive hearing loss occurs when the normal mechanical pathways to provide sound to hair cells in the cochlea are impeded, for example, by damage to the ossicular chain or ear canal. Individuals who suffer from conductive hearing loss may still have some form of residual hearing because the hair cells in the cochlea are generally undamaged.

Individuals who suffer from conductive hearing loss are typically not considered to be candidates for a cochlear implant due to the irreversible nature of the cochlear implant. Specifically, insertion of the electrode array into a recipient's cochlea results in the destruction of a majority of hair cells within the cochlea. This results in the loss of residual hearing by the recipient.

Rather, individuals suffering from conductive hearing loss typically receive an acoustic hearing aid, referred to as a hearing aid herein. Hearing aids rely on principles of air conduction to transmit acoustic signals through the outer and middle ears to the cochlea. In particular, a hearing aid typically uses an arrangement positioned in the recipient's ear canal to amplify a sound received by the outer ear of the recipient. This amplified sound reaches the cochlea and causes motion of the cochlea fluid and stimulation of the cochlea hair cells.

Unfortunately, not all individuals who suffer from conductive hearing loss are able to derive suitable benefit from hearing aids. For example, some individuals are prone to chronic inflammation or infection of the ear canal and cannot wear hearing aids. Other individuals have malformed or absent outer ear and/or ear canals as a result of a birth defect, or as a result of common medical conditions such as Treacher Collins syndrome or Microtia. Furthermore, hearing aids are typically unsuitable for individuals who suffer from single-sided deafness (total hearing loss only in one ear) or individuals who suffer from mixed hearing losses (i.e., combinations of sensorineural and conductive hearing loss).

When an individual having fully functioning hearing receives an input sound, the sound is transmitted to the cochlea via two primary mechanisms: air conduction and bone conduction. As noted above, hearing aids rely primarily on the principles of air conduction. In contrast, other devices, referred to as bone conduction devices, rely predominantly on vibration of the bones of the recipients skull to provide acoustic signals to the cochlea.

Those individuals who cannot derive suitable benefit from hearing aids may benefit from bone conduction devices. Bone conduction devices convert a received sound into a mechanical vibration representative of the received sound. This vibration is then transferred to the bone structure of the skull, causing vibration of the recipient's skull. This skull vibration results in motion of the fluid of the cochlea. Hair cells inside the cochlea are responsive to this motion of the cochlea fluid, thereby generating nerve impulses, which result in the perception of the received sound.

SUMMARY

In one aspect of the invention, a bone conduction device for enhancing the hearing of a recipient is provided. The bone conduction device comprises a sound input device configured to receive sound signals and generate a plurality of signals representative of the sound signals, an electronics module configured to receive the plurality of signals and having a first control setting configured to control a first characteristic of at least one of the plurality of signals and a second control setting configured to control a second characteristic of the at least one of the plurality of signals, a vibrator configured to receive the plurality of signals representative of the sound signals and transmit vibrations to the recipient's bone, and a user interface having a first interface control configured to interface with the first control setting and alter the first characteristic and a second interface control configured to interface with the second control setting and alter the second characteristic.

In a second aspect of the invention, a bone conduction device for enhancing the hearing of a recipient is provided. A sound input device configured to receive sound signals, a memory unit configured to store data, a user interface configured to allow the recipient to access the data, and an LCD configured to display the data.

In a third aspect of the invention, a computer program product is provided. The computer program product comprises a computer usable medium having computer readable program code embodied therein configured to allow recipient access to data stored in a memory unit of a bone conduction hearing device, the computer program product comprises computer readable code configured to cause a computer to enable recipient input into the bone conduction hearing device through a user interface and computer readable code configured to cause a computer to display specific data stored in the memory unit based on the input from the user interface.

BRIEF DESCRIPTION OF THE DRAWINGS

Illustrative embodiments of the present invention are described herein with reference to the accompanying drawings, in which.

DETAILED DESCRIPTION

Embodiments of the present invention are generally directed to a bone conduction hearing device ("hearing device") for converting a received sound signal into a mechanical force for delivery to a recipient's skull. The bone conduction device includes a user interface that enables the recipient to alter various settings in the bone conduction device. Such a user interface may further enable the recipient access to data stored within the hearing device with or without the use of an external or peripheral device.

Some embodiments of the present invention include a hearing device that enables the recipient to set or alter operation of the buttons or touch screen to allow a customizable user interface. Additional embodiments allow the recipient to view a display screen to increase the ease of user interface. Further embodiments allow the recipient to interface with various programs and capabilities integrated in the hearing device, such as, data storage or voice and/or data transmission or reception via wireless communication.

Figure 1:
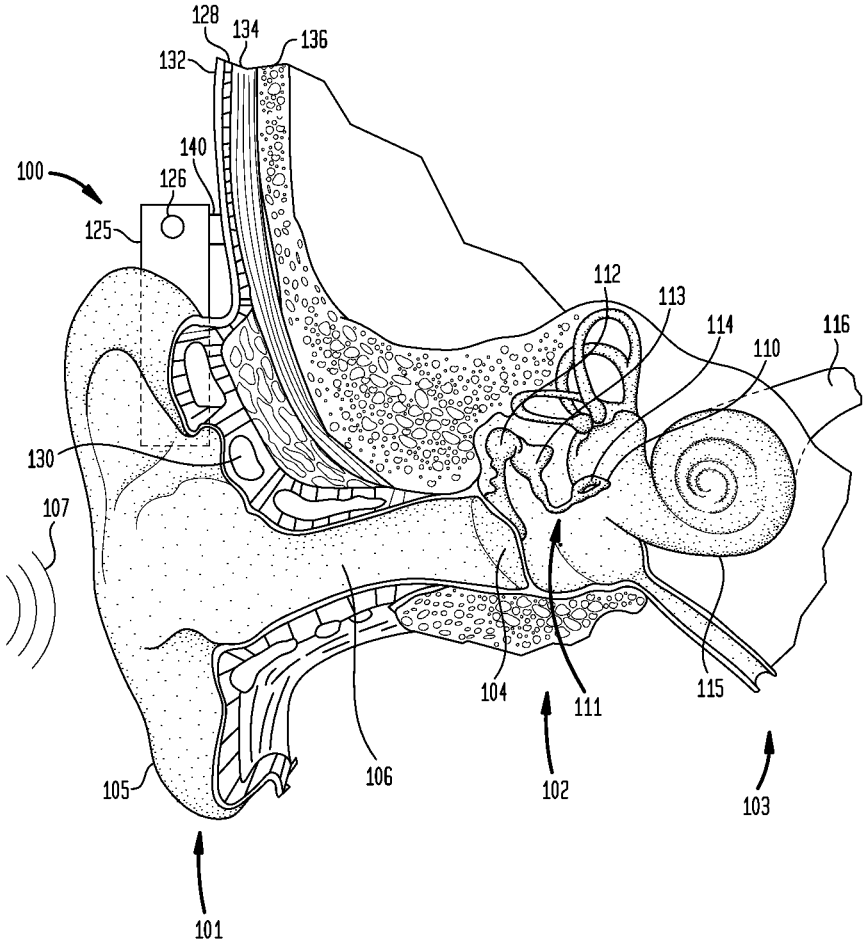
FIG. 1 is a perspective view of an exemplary medical device, namely a bone conduction device, in which embodiments of the present invention may be advantageously implemented.

FIG. 1 is a cross sectional view of a human ear and surrounding area, along with a side view of one of the embodiments of a bone conduction device 100. In fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify acoustic wave 107, causing oval window 110 to articulate, or vibrate. Such vibration sets up waves of fluid motion within cochlea 115. The motion, in turn, activates tiny hair cells (not shown) that line the inside of cochlea 115. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 may be positioned behind outer ear 101 of the recipient; however it is noted that device 100 may be positioned in any suitable manner.

In the embodiments illustrated in FIG. 1, bone conduction device 100 comprises a housing 125 having at least one microphone 126 positioned therein or thereon. Housing 125 is coupled to the body of the recipient via coupling 140. As described below, bone conduction device 100 may comprise a signal processor, a transducer, transducer drive components and/or various other electronic circuits/devices.

In accordance with embodiments of the present invention, an anchor system (not shown) may be implanted in the recipient. As described below, the anchor system may be fixed to bone 136. In various embodiments, the anchor system may be implanted under skin 132 within muscle 134 and/or fat 128 or the hearing device may be anchored in another suitable manner. In certain embodiments, a coupling 140 attaches device 100 to the anchor system.

Figure 2A:
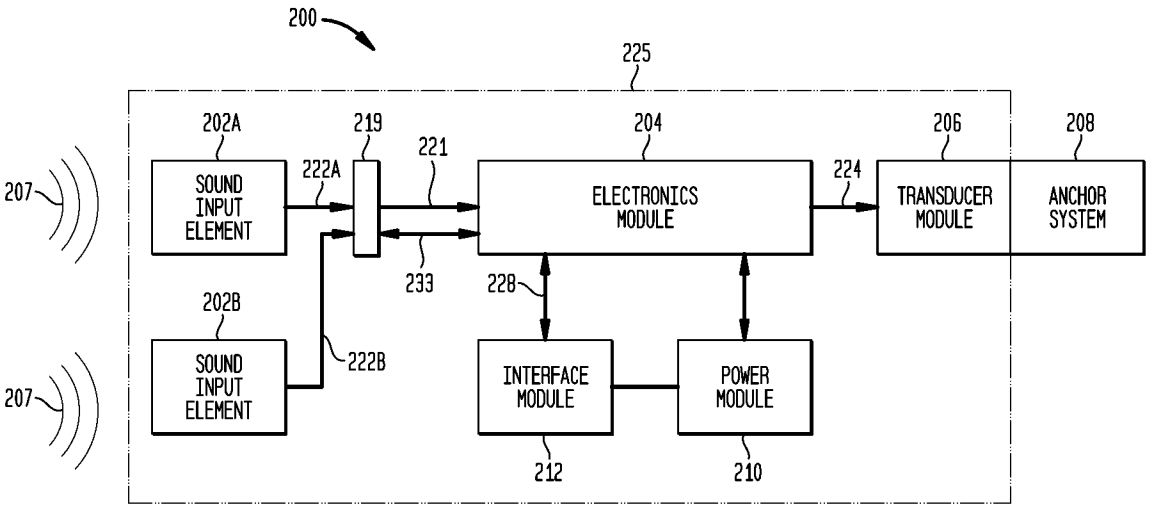
FIG. 2A is a high-level functional block diagram of a bone conduction device, such as the bone conduction device of FIG. 1.

A functional block diagram of one embodiment of bone conduction device 100, referred to as bone conduction device 200, is shown in FIG. 2A. In the illustrated embodiment, sound 207 is received by sound input elements 202*a* and 202*b*, which may be, for example, microphones configured to receive sound 207, and to convert sound 207 into an electrical signal 222. Or, for example, one or more of the sound input elements 202*a* and 202*b* might be an interface that the recipient may connect to a sound source, such as for example a jack for receiving a plug that connects to a headphone jack of a portable music player (e.g., MP3 player) or cell phone. It should be noted that these are but some exemplary sound input elements, and the sound input elements may be any component or device capable of providing a signal regarding a sound. Although bone conduction device 200 is illustrated as including two sound input elements 202*a* and 202*b*, in other embodiments, bone conduction device may comprise any number of sound input elements.

As shown in FIG. 2A, electrical signals 222*a* and 222*b* are output by sound input elements 202*a* and 202*b*, respectively, to a sound input element selection circuit 219 that selects the sound input element or elements to be used. Selection circuit 219 thus outputs a selected signal 221 that may be electrical signal 222*a*, 222*b*, or a combination thereof. As discussed below, the selection circuit 219 may select the electrical signal(s) based on, for example, input from the recipient, automatically via a switch, the environment, and/or a sensor in the device, or a combination thereof. Additionally, in embodiments, the sound input elements 202 in addition to sending information regarding sound 207 may also transmit information indicative of the position of the sound input element 202 (e.g., its location in the bone conduction device 200) in electrical signal 222.

The selected signal 221 is output to an electronics module 204. Electronics module 204 is configured to convert electrical signals 221 into an adjusted electrical signal 224. Further, electronics module 204 may send control information via control signal 233 to the input selection circuit, such as, for example, information instructing which input sound element(s) should be used or information instructing the input selection circuit 219 to combine the signals 222*a* and 222*b* in a particular manner. It should be noted that although in FIG. 2A, the electronics module 204 and input element selection circuit 219 are illustrated as separate functional blocks, in other embodiments, the electronics module 204 may include the input element selection circuit 219. As described below in more detail, electronics module 204 may include a signal processor, control electronics, transducer drive components, and a variety of other elements.

As shown in FIG. 2A, a transducer 206 receives adjusted electrical signal 224 and generates a mechanical output force that is delivered to the skull of the recipient via an anchor system 208 coupled to bone conduction device 200. Delivery of this output force causes one or more of motion or vibration of the recipient's skull, thereby activating the hair cells in the cochlea via cochlea fluid motion.

FIG. 2A also illustrates a power module 210. Power module 210 provides electrical power to one or more components of bone conduction device 200. For ease of illustration, power module 210 has been shown connected only to interface module 212 and electronics module 204. However, it should be appreciated that power module 210 may be used to supply power to any electrically powered circuits/components of bone conduction device 200.

Bone conduction device 200 further includes an interface module 212 that allows the recipient to interact with device 200. For example, interface module 212 may allow the recipient to adjust the volume, alter the speech processing strategies, power on/off the device, etc., as discussed in more detail below. Interface module 212 communicates with electronics module 204 via signal line 228.

In the embodiment illustrated in FIG. 2A, sound input elements 202*a* and 202*b*, electronics module 204, transducer 206, power module 210 and interface module 212 have all been shown as integrated in a single housing, referred to as housing 225. However, it should be appreciated that in certain embodiments, one or more of the illustrated components may be housed in separate or different housings. Similarly, it should also be appreciated that in such embodiments, direct connections between the various modules and devices are not necessary and that the components may communicate, for example, via wireless connections.

Figure 2B:
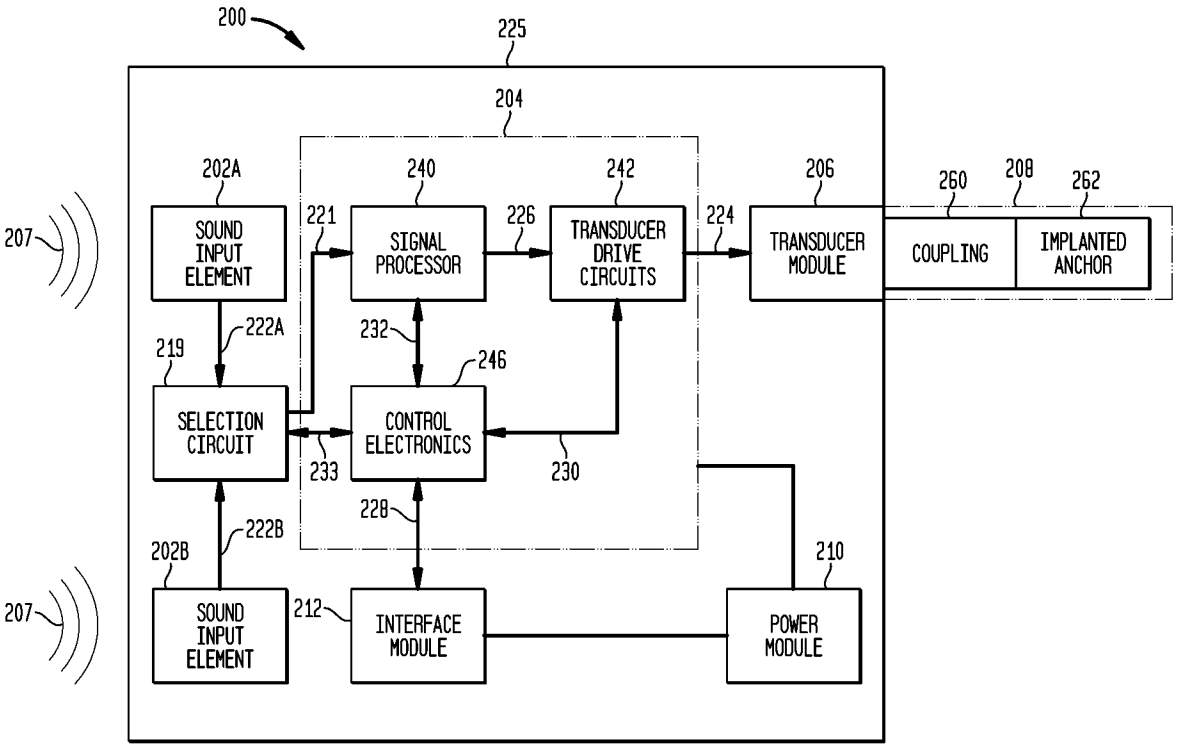
FIG. 2B is detailed functional block diagram of the bone conduction device illustrated in FIG. 2A.

FIG. 2B illustrates a more detailed functional diagram of the bone conduction device 200 illustrated in FIG. 2A. As illustrated, electrical signals 222*a* and 222*b* are output from sound input elements 202*a* and 202*b* to sound input selection circuit 219. The selection circuit may output electrical signal 221 to signal processor 240. In one embodiment, the selection circuit is a two way switch that is activated by the recipient; however, it is noted that the selection switch may be any switch for operating a plurality of sound input elements. Further, selection circuit 219 may comprise a processor and other components, such that selection circuit 219 may implement a particular combination strategy for combining one or more signals from the sound input elements.

Signal 221 may be signal 222*a*, 222*b* or a combination thereof. Signal processor 240 uses one or more of a plurality of techniques to selectively process, amplify and/or filter electrical signal 221 to generate a processed signal 226. In certain embodiments, signal processor 240 may comprise substantially the same signal processor as is used in an air conduction hearing aid. In further embodiments, signal processor 240 comprises a digital signal processor.

Processed signal 226 is provided to transducer drive components 242. Transducer drive components 242 output a drive signal 224, to transducer 206. Based on drive signal 224, transducer 206 provides an output force to the skull of the recipient.

For ease of description the electrical signal supplied by transducer drive components 242 to transducer 206 has been referred to as drive signal 224. However, it should be appreciated that processed signal 224 may comprise an unmodified version of processed signal 226.

As noted above, transducer 206 generates an output force to the skull of the recipient via anchor system 208. As shown in FIG. 2B, anchor system 208 comprises a coupling 260 and an implanted anchor 262. Coupling 260 may be attached to one or more of transducer 206 or housing 225. For example, in certain embodiments, coupling 260 is attached to transducer 206 and vibration is applied directly thereto. In other embodiments, coupling 260 is attached to housing 225 and vibration is applied from transducer 206 through housing 225.

As shown in FIG. 2B, coupling 260 is coupled to an anchor implanted in the recipient, referred to as implanted anchor 262. As explained with reference to FIG. 3, implanted anchor 262 provides an element that transfers the vibration from coupling 260 to the skull of the recipient.

As noted above, a recipient may control various functions of the device via interface module 212. Interface module 212 may include one or more components that allow the recipient to provide inputs to, or receive information from, elements of bone conduction device 200, such, as for example, one or more buttons, dials, display screens, processors, interfaces, etc.

As shown, control electronics 246 may be connected to one or more of interface module 212 via control line 228, signal processor 240 via control line 232, sound input selection circuit 221 via control line 233, and/or transducer drive components 242 via control line 230. In embodiments, based on inputs received at interface module 212, control electronics 246 may provide instructions to, or request information from, other components of bone conduction device 200. In certain embodiments, in the absence of recipient inputs, control electronics 246 control the operation of bone conduction device 200.

Figure 3:
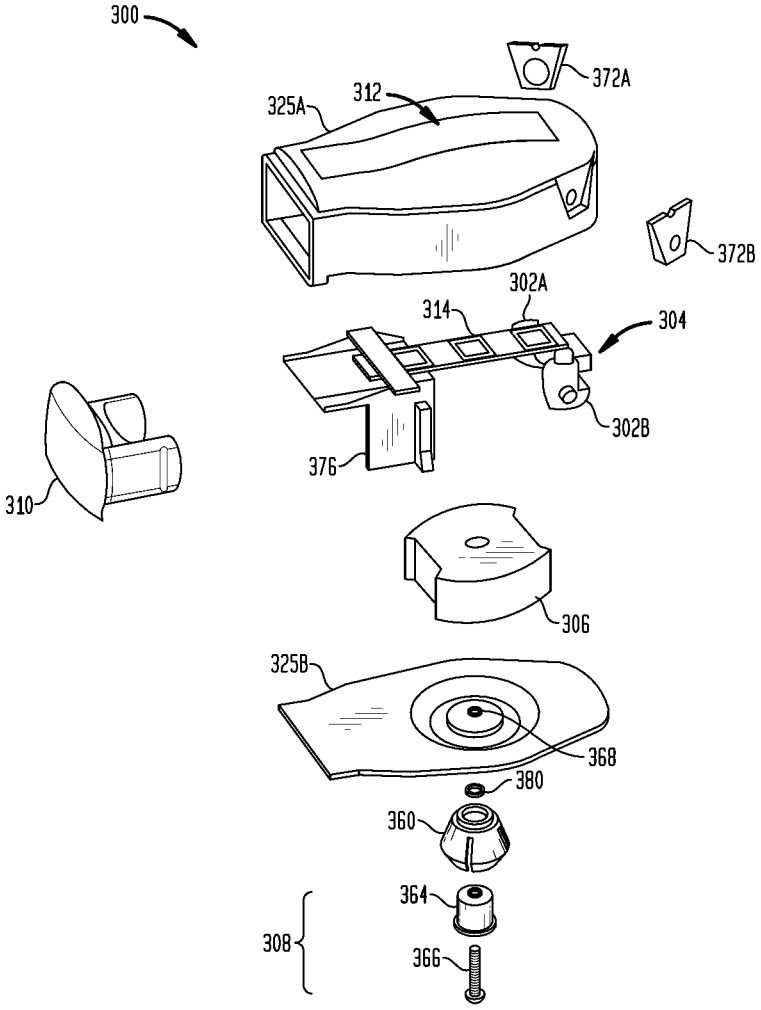
FIG. 3 is an exploded view of an embodiment of a bone conduction device in accordance with one embodiment of FIG. 2B.

FIG. 3 illustrates an exploded view of one embodiment of bone conduction device 200 of FIGS. 2A and 2B, referred to herein as bone conduction device 300. As shown, bone conduction device 300 comprises an embodiment of electronics module 204, referred to as electronics module 304. As illustrated, electronics module 304 includes a printed circuit board 314 (PCB) to electrically connect and mechanically support the components of electronics module 304. Further, as explained above, electronics module 304 may also include a signal processor, transducer drive components and control electronics. For ease of illustration, these components have not been illustrated in FIG. 3.

A plurality of sound input elements are attached to PCB 314, shown as microphones 302*a* and 302*b* to receive a sound. As illustrated, the two microphones 302*a* and 302*b* are positioned equidistant or substantially equidistant from the longitudinal axis of the device; however, in other embodiments microphones 302*a* and 302*b* may be positioned in any suitable position. By being positioned equidistant or substantially equidistant from the longitudinal axis, bone conduction device 300 can be used on either side of a patient's head. The microphone facing the front of the recipient is generally chosen using the selection circuit as the operating microphone, so that sounds in front of the recipient can be heard; however, the microphone facing the rear of the recipient can be chosen, if desired. It is noted that it is not necessary to use two or a plurality of microphones and only one microphone may be used in any of the embodiments described herein.

Bone conduction device 300 further comprises a battery shoe 310 for supplying power to components of device 300. Battery shoe 310 may include one or more batteries. As shown, PCB 314 is attached to a connector 376 configured to mate with battery shoe 310. This connector 376 and battery shoe 310 may be, for example, configured to releasably snap-lock to each other. Additionally, one or more battery connects (not shown) may be disposed in connector 376 to electrically connect battery shoe 310 with electronics module 304.

In the embodiment illustrated in FIG. 3, bone conduction device 300 further includes a two-part housing 325, comprising first housing portion 325*a* and second housing portion 325*b*. Housing portions 325 are configured to mate with one another to substantially seal bone conduction device 300.

In the embodiment of FIG. 3, first housing portion 325*a* includes an opening for receiving battery shoe 310. This opening may be used to permit battery shoe 310 to inserted or removed by the recipient through the opening into/from connector 376. Also in the illustrated embodiment, microphone covers 372 can be releasably attached to first housing portion 325*a*. Microphone covers 372 can provide a barrier over microphones 302 to protect microphones 302 from dust, dirt or other debris.

Bone conduction device 300 further may include an interface module 212, referred to in FIG. 3 as interface module 312. Interface module 312 is configured to provide information to or receive user input from the user, as will be discussed in further detail below with reference to FIGS. 4A-E.

Also as shown in FIG. 3, bone conduction device 300 may comprise a transducer 206, referred to as transducer 306, and an anchor system 208, referred to as anchor system 308 in FIG. 3. As noted above, transducer 306 may be used to generate an output force using anchor system 308 that causes movement of the cochlea fluid to enable sound to be perceived by the recipient. Anchor system 308 comprises a coupling 360 and implanted anchor 362. Coupling 360 may be configured to attach to second housing portion 325*b*. As such, vibration from transducer 306 may be provided to coupling 360 through housing 325*b*. As illustrated, housing portion 325*b* may include an opening to allow a screw (not shown) to be inserted through opening 368 to attach transducer 306 to coupling 360. In such embodiments, an O-ring 380 may be provided to seal opening 368 around the screw.

As noted above, anchor system 308 includes implanted anchor 362. Implanted anchor 362 comprises a bone screw 366 implanted in the skull of the recipient and an abutment 364. In an implanted configuration, screw 366 protrudes from the recipient's skull through the skin. Abutment 364 is attached to screw 366 above the recipient's skin. In other embodiments, abutment 364 and screw 366 may be integrated into a single implantable component. Coupling 360 is configured to be releasably attached to abutment 364 to create a vibratory pathway between transducer 306 and the skull of the recipient. Using coupling 360, the recipient may releasably detach the hearing device 300 from anchor system 308. The recipient may then make adjustments to the hearing device 300 using interface module 312, and when finished reattach the hearing device 300 to anchor system 308 using coupling 360.

FIGS. 4-8 illustrate exemplary interface modules that may be used, for example, as interface module 312 of FIG. 3. As will be discussed in further detail below, the hearing device 400 may include various user features, such as a push button control interface(s), dials, an LCD display, a touch screen, wireless communications capability to communicate with an external device, an/or, for example, an ability to audibly communicate instructions to the recipient.

Figure 4:
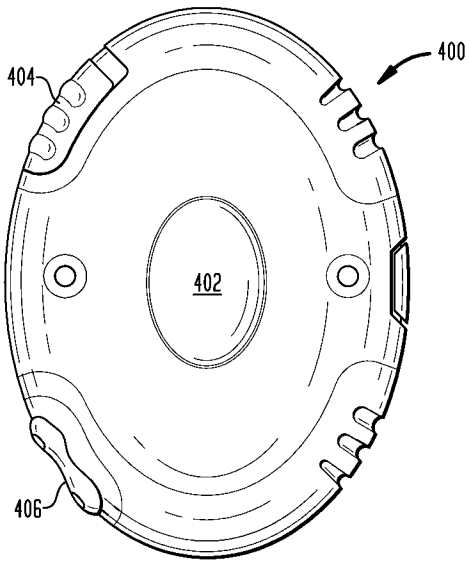
FIG. 4 illustrates an exemplary bone conduction device comprising a user interface, in accordance with an embodiment of the present invention.

FIG. 4 illustrates an exemplary hearing device 400 that includes a central push button 402 and side buttons 404 and 406. Each of these buttons may have a particular shape, texture, location, or combination thereof to aid the recipient in quickly identifying a particular button without the need for the recipient to look at the button. The central push button may, for example, allow the recipient to turn the device on and off. The side buttons 404 may allow the recipient to adjust the volume and the side buttons 406 may allow the recipient to program the hearing device. For example, the recipient may use the side buttons 406 to adjust various control settings for the hearing device 400. Exemplary control settings that the recipient may adjust include settings for amplification, compression, maximum power output (i.e. a restriction to the maximum power output that is related to the recipients ability to hear at each frequency or frequency band), noise reduction, directivity of the sound received by the sound input elements, speech enhancement, damping of certain resonance frequencies (e.g. using electronic notch filters), and the frequency and/or amplitude of an alarm signal. The control settings may, for example, be organized in folders to aid the recipient in locating control settings for adjustment In an embodiment in which the control settings are organized in menus, side buttons 406 may comprise a top button 405 that the recipient may use to move up in the menu and a bottom button 407 that the recipient may use to move down in the menu. The following provides a simplified example of how a recipient may adjust a control setting of the hearing device. In this example, the top menu may include 1) first level menus of amplification characteristics, 2) sound directivity, and 3) noise reduction settings. The amplification characteristics menu may then include options for 1) selecting amongst predetermined settings, and 2) manually adjusting the amplification characteristics. In such an example, if the recipient desires to adjust amplification characteristics for the hearing device, the recipient may press the top button 405 to bring up the menu. This selection may be, for example, indicated to the recipient using a speaker in the hearing device 400 issuing an audible signal such as, for example, a particular beep, sound, or word. Or, for example, the electronics module may issue commands to the transducer module so that the recipient receives an audible signal (e.g., hears the words "top menu," a buzz, or a beep) via the anchor system. Providing vibration information or audible information (e.g., via a speaker or using the transducer) to the recipient may aid the recipient in being able to adjust the hearing device 400 without the recipient removing the hearing device 400 from the anchor system.

The recipient may then use the top and bottom buttons 405, 407 to scroll through this top menu to the desired menu, which in this example, is the amplification characteristics menu. The recipient may be made aware of which menu they are currently on, by an audible command (e.g., 1 beep indicating the first menu, using the transducer and bone conduction device so the recipient hears "amplification," or some other mechanism). When the hearing device has reached the desired menu (e.g., the recipient hears the audible signal for the desired menu), the recipient may then select this menu using a button, such as button 404. The recipient may then scroll through the next set of menus in a similar manner until the recipient reaches and adjusts the desired setting as desired. The recipient may, for example, use a button, such as button 404 to select the desired setting. In one example, the recipient may use the button 404 in a manner used for increasing the volume to make a selection, while the button 404 may be used in manner for decreasing the volume to cancel the selection, move back in the menu, or for example, terminate the process (e.g., by quickly moving button 404 in a particular manner, such as, quick pressing button 404 downward twice).

In this example, after the recipient selects the amplification menu, the recipient may then select the menu for selecting predetermined settings or manual adjustments. If the recipient selects the manual adjustment menu, the recipient may then be presented with the ability to increase or decrease the amplification for different frequency ranges. Thus, the recipient may be able to individually boost (increase) or decrease the volume of lower (bass) frequencies, midrange and higher frequencies. Or, if the recipient desires, rather than manually adjusting the amplification settings, the recipient may select from the predetermined settings menu to select from amongst a plurality of predetermined amplification settings, such as, for example, one for listening to music (e.g., where the bass frequencies are boosted while the treble frequencies are decreased in volume), or for crowded rooms, etc. The hearing device may adjust the amplification of the various frequencies by, for example, adjusting the amount of power (e.g., in millivolts) in the particular frequency range provided to the transducer for generating the sound. It should be noted that this is but one exemplary mechanism that the hearing device 400 may be used to adjust control settings for the device, and other mechanisms may be used without departing from the invention.

As noted above in discussing FIG. 3, the hearing device may comprise two or more microphones. In such an example, the recipient may use the hearing device 400 to manually select between the various microphones. For example, the bone conduction device 300 may have four or more microphones positioned thereon or therein, with one or more microphone positioned in each quadrant. Based on the direction of sound, the recipient, using the user interface of the hearing device 400, may select one or more microphones positioned optimally to receive the sound. The recipient may accomplish this, for example, using buttons 406 to select a menu for selecting the microphones and then select which microphone should be used, or for example, function as a dominant microphone. If a microphone is selected to be the dominant microphone, then the signal processor may select and use the dominant signal and disregard the other signals in the event certain conditions arise, such as, if the signal processor receives multiple noisy signals from each of the microphones and the signal processor is unable to determine which microphone signal includes the sound that would be of principal interest to the recipient (e.g., speech).

Similarly, in certain embodiments, the recipient may use the user interface to select an order of dominance for the microphones, such that, for example, the signal processor, in the event of noisy conditions, first tries to decode the primary dominant microphone signal. If, however, the signal processor determines that this decoding fails to meet certain conditions (e.g., it appear to be noise), the signal processor then selects the next most dominant microphone signal. The signal processor may then, for example, continue selecting and decoding signals using this order of dominance until a microphone signal is decoded that meets specified conditions (e.g, the signal appears to be speech or music). It should be noted, however, that these are merely exemplary strategies that may be employed for selecting amongst multiple microphone signals, and in other embodiments other strategies may be used. For example, in an embodiment, the signal processor may utilize a weighting system instruct the selection circuit to weight the different microphone signals and then combine the weighted signals.

Additionally, in embodiments, the recipient may use the user interface to select a control setting that turns on a direction finding algorithm for selecting between microphones. Such algorithms are known to one of ordinary skill in the art. For example, simultaneous phase information from each receiver may be used to estimate the angle-of-arrival of the sound. Using such algorithms, the signal processor may determine a suitable microphone output signal or a plurality of suitable microphone outputs to use in providing the sound to the recipient. It should be noted that these are but some exemplary control settings that the recipient may adjust using the user interface, and the user interface may used to adjust all other user adjustable settings as well. Additionally, although the embodiments are discussed with reference to the recipient making the adjustments, it should be understood that any user (e.g., the recipient, a doctor, a family member, friend, etc.) may use the user interface to make these adjustments. A further description of exemplary user mechanisms a bone conduction device may use to select or combine signals from multiple sound input devices is provided in the U.S. Patent Application by John Parker entitled "A Bone Conduction Device Having a Plurality of Sound Input Devices," filed concurrent with the present application, which is incorporated by reference herein in its entirety.

Figure 5:
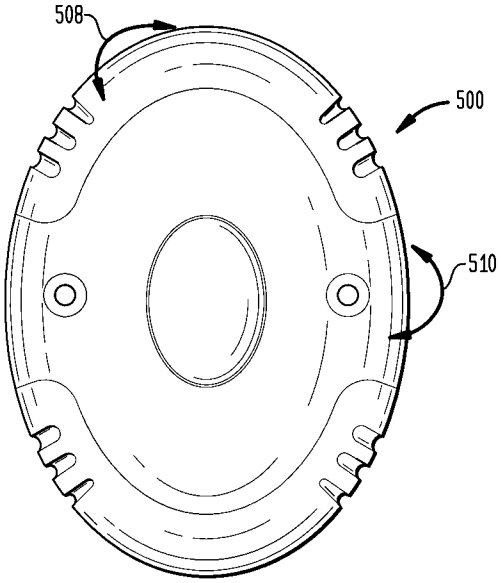
FIG. 5 illustrates another exemplary bone conduction device comprising a user interface, in accordance with an embodiment of the present invention.

FIG. 5 illustrates a hearing device 500 wherein the hearing device may be adjusted by manipulation of the hearing device. For example, in this embodiment, tilting of the device up or down in the direction of arrow 508 adjusts the volume. Control settings may be adjusted and/or altered by tilting of the device side to side as indicated by arrow 510 and the device may be turned on and off by tilting the hearing device up and holding for a predetermined amount of time. As one of ordinary skill in the art would understand, each of these adjustments may be performed using any suitable switching or adjustment device, such as a potentiometer. Further, as with the embodiment of FIG. 4, audible instructions or indications may be provided to the recipient via a speaker or the hearing device's transducer to aid the recipient in adjusting the hearing device. Further, the hearing device 500 may use a menu system that the recipient may use to adjust the control settings for the hearing device 500, such as discussed above with reference to FIG. 4.

Figure 6:
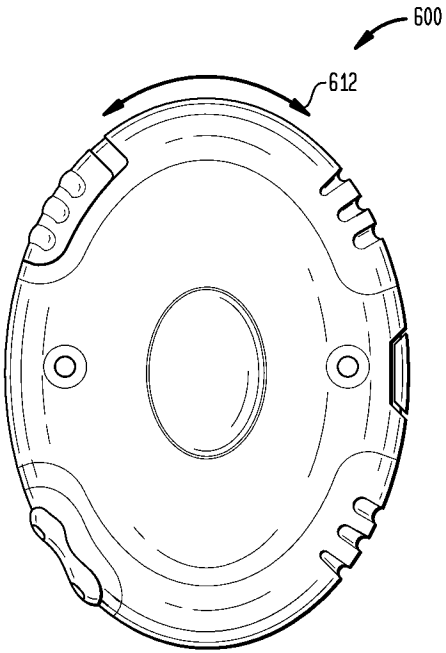
FIG. 6 illustrates another exemplary bone conduction device comprising a user interface, in accordance with an embodiment of the present invention.

FIG. 6 illustrates yet another exemplary hearing device 600 with a user interface. In this example, a recipient may adjust the volume of the hearing device 600 by twisting or moving the hearing device in the direction of arrows 612. Further, the recipient may adjust the control settings discussed above by, for example, pulling the hearing device outwardly or pushing the hearing device inwardly. The hearing device 600 may also include a button 614 for turning the device on or of (i.e., an on/off button). As with the embodiments of FIGS. 4-5, the hearing device 600 may, for example, include a speaker, vibration device, and/or use the transducer to be provide audible and/or vibration information/instructions to the recipient in adjusting the control settings for the hearing device. Further, the hearing device 600 may use a menu system that the recipient may use to adjust the control settings for the hearing device 600, such as discussed above with reference to FIG. 4.

Figure 7:
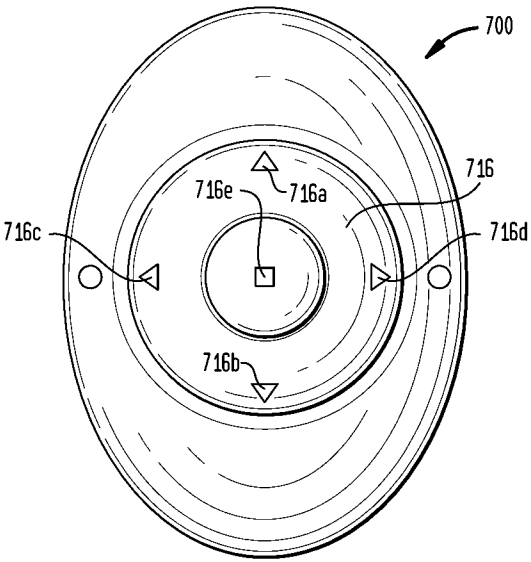
FIG. 7 illustrates another exemplary bone conduction device comprising a user interface, in accordance with an embodiment of the present invention.

FIG. 7 illustrates yet another exemplary hearing device 700 with a user interface. In this example, the recipient may control the volume using setting arrows 716*a* and 716*b* on switch 716. The recipient may further adjust the control settings for the hearing device 700 using buttons 716*c* and 716*d* and the hearing device may be turned off and on using center button 716*e*. The recipient may adjust the control settings for the hearing device 700 using the buttons 716 in a similar manner to the methods discussed above with reference to FIGS. 4-6.

Figure 8:
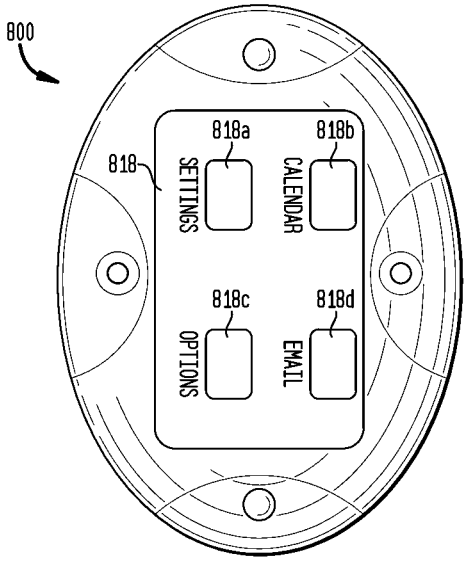
FIG. 8 illustrates another exemplary bone conduction device comprising a user interface, in accordance with an embodiment of the present invention.

FIG. 8 illustrates an exemplary hearing device 800 that includes a display screen 818. In one embodiment, the display screen 818 is a touch screen LCD, allowing the user interface to have no or minimal push buttons. In use, the recipient may detach the hearing device 800 from its anchor so that the recipient may hold the hearing device and view the display screen 818. The recipient may then adjust the control settings, volume, etc., and when done re-attach the hearing device 800 to its anchor near the recipient's ear.

The display screen 818 may display icons, such as icons 818*a-d* to menus, display programs, and/or data stored in the device (e.g., settings 818*a*, calendar 818*b*, options 818*c* and email 818*d*). Using display screen 818, the recipient may navigate through a menu(s) of control settings, such as was discussed above to adjust the control settings. For example, if display screen 818 is a touch screen, the recipient may select the desired menu(s) by touching a particular location of the screen (e.g., a displayed icon or button for the desired menu). The recipient may also adjust the volume settings of the hearing device 800 using the display screen 818 (e.g., by touching a particular location(s) on the display screen 818 if it is a touchscreen). As noted, the display screen 818 does not necessarily need to be a touch screen and hard buttons or other control mechanisms (e.g., such as discussed above with reference to FIGS. 6-7) may be used in conjunction with the display screen 818. Any combination of a display screen, buttons and touch screen capabilities may be implemented.

The display screen 818 may also be used to display the current setting for each of the control settings. For example, if the recipient navigates to a particular control setting, the display screen 818 may then display the current setting for the particular control setting. The recipient may then adjust the setting, and the display screen 818 may accordingly display the new settings. When finished, the recipient may select to save the setting by, for example, pressing a particular button displayed on the display screen 818 (if the display screen is a touch screen), or by pressing a particular hard button, or using some other control mechanism. As noted above, in an embodiment, the control settings and hearing device data may be categorized and stored in menus and sub-menus that the recipient can access through use of the user interface and the display screen 818. The data may be stored in any usable format and may be displayed on the display screen and/or may be a wav file or compressed audio file that may be perceived through the hearing device. The hearing device may be operable to display the control settings or any other type of data using scrolling menus such that some of the data is visible via the display screen while other data is "off screen". As the recipient scrolls through the data the "off screen" data is visible via the display screen and some of the data previously visible moves "off screen". The recipient can scroll through the data using the user interface.

Figure 9:
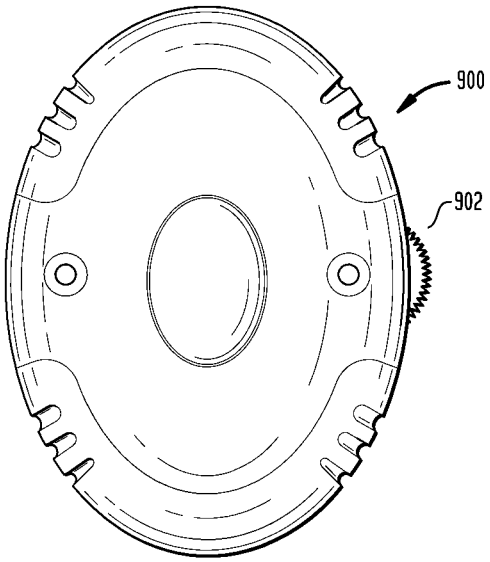

FIG. 9 illustrates yet another exemplary hearing device 900 with a user interface. In this embodiment, the user interface may comprise a dial 902. In this example, a recipient may adjust the volume of the hearing device 900 by, for example, rotating the dial 902 in one direction to increase the volume and rotating the dial 902 in the opposite direction to reduce the volume. In an embodiment, a recipient may be able to press the dial 902 to turn the device on or off, such as, for example, by pressing the dial 902 into the hearing device 900 and holding it there for a particular period of time (e.g., 1 or more seconds). Once on, a recipient may be able to adjust settings other than the volume by pressing the dial for a shorter amount of time (e.g., less than 1 second) to change the control setting to be adjusted.

As with the embodiments of FIGS. 4-5, the hearing device 900 may, for example, include a speaker, vibration device, and/or use the transducer to be provide audible and/or vibration information/instructions to the recipient in adjusting the control settings for the hearing device, such as, for example to indicate which control setting will be adjusted by rotating the dial. Further, the hearing device 900 may use a menu system that the recipient may use to adjust the control settings for the hearing device 900, such as discussed above with reference to FIG. 4. In this manner, the recipient may press the dial 902 a number of times to select a particular control setting to be adjusted. Then, the recipient may adjust the setting by rotating the dial, such that the value for the setting is increased by rotating the dial in one direction, and decreased by rotating the dial in the other direction. In an embodiment, after a control setting is adjusted, the hearing device 900 may automatically return to the volume control setting if the recipient does not make any adjustments for a particular period of time (e.g., 5 or more seconds). This may be helpful in preventing a recipient from accidentally adjusting a particular setting by rotating the dial, when the recipient meant to adjust the volume, because the recipient accidentally left the hearing device 900 set to adjust this particular setting.

In an embodiment, hearing device 900 may be configured such that it may be attached to either side of a recipients head. That is, hearing devices in accordance with embodiments of the present invention may be configured so that the hearing device may be used both with anchor systems implanted on the right side and left side of a recipients head. This may be helpful because it may not be able to tell during manufacture of the hearing device which side of a recipient's head it will be attached to. Or, for example, for recipients in which anchor systems are implanted on both sides of the recipient's head, it may be beneficial for the hearing device 900 to be attached to either side of the recipient's head.

In an embodiment, the hearing device 900 may include the capability to determine which side of a recipient's head the hearing device is attached. And, using this information, hearing device 900 may alter the way in which dial 902 operates. For example, in an embodiment, the hearing device 900 may be configured such that the dial 902 will face towards the front of the recipient's head, regardless of which side of the head it is attached. In addition, the hearing device 900 may be able to alter the functionality of the dial so that regardless of which side of the head it is attached to, rotating the dial 902 in the upwards direction will increase the setting (e.g., volume), and rotating the dial 902 in the opposite direction will decrease the setting (e.g., volume), or visa versa. Thus, in an embodiment, hearing device 900 may be configured to determine to which side of the head it is attached, and then alter the operation of the dial 902 so that the dial 902 operates in the same manner, regardless of which side of the head the hearing device 900 is attached. Hearing device 900 may employ various mechanisms for determining to which side of the head it is attached. For example, in one embodiment, hearing device 900 may include a mercury switch oriented such that the switch is closed if the hearing device is installed on one side of the patient's head and open if it installed on the other side of the patient's head. Or, for example, hearing device 900 may employ mechanisms such as disclosed in the co-pending application entitled "A Bone Conduction Device Having a Plurality of Sound Input Devices," (Attorney Docket No.: 22409-00493 US) filed on the same day as the present application, and which is hereby incorporated by reference herein in its entirety.

Figure 10:
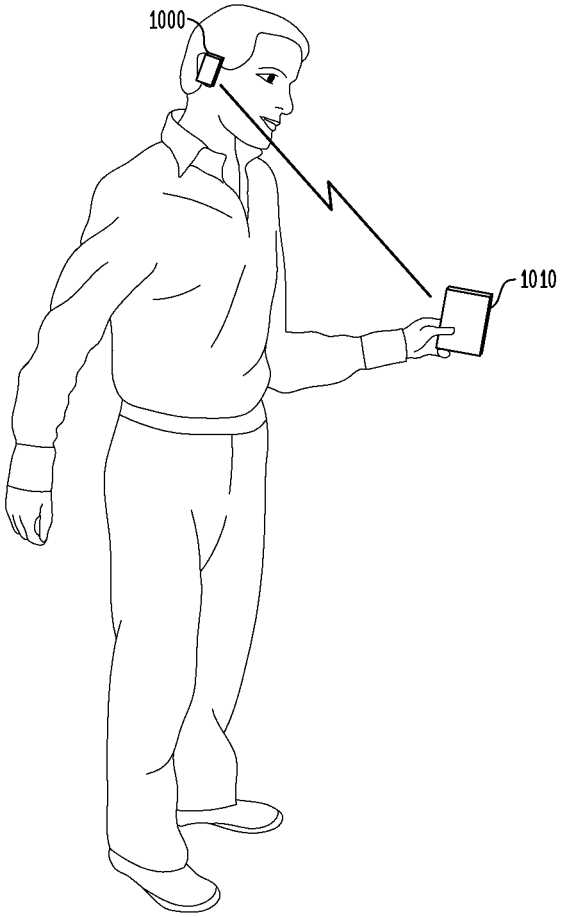
FIG. 10 illustrates an exemplary bone conduction device wireless communicating with an external device, in accordance with an embodiment of the present invention.

FIG. 10 illustrates yet another embodiment of a hearing device 1000. In this example, the user interface of the hearing device 1000 includes wireless communication capabilities that permit the hearing device to wirelessly communicate with an external device 1010. For example, the hearing device

1000 may be BLUETOOTH enabled such that the hearing device can communicate via BLUETOOTH with other BLUETOOTH enabled devices, such as, for example, a personal digital assistant ("PDA"), a laptop or desktop computer, a cellphone, etc. In such an embodiment, a user interface may be displayed on the external device 1010 that permits the recipient to adjust the control settings or view data regarding the hearing device using the external device 1010. This may be helpful in allowing the recipient to make adjustment to the control settings of the hearing device or view data regarding the hearing device 1000 without the recipient removing the hearing device 1000 from its anchor. Additionally, in an embodiment, the external device 1010 may also be able to wireless transmit music or other audible information to the hearing device 1000 so that the recipient may hear the music or audible information. In such an example, hearing device 1000 may operate in a manner similar to that of a BLUETOOTH enabled headset. Although this example was discussed with reference to BLUETOOTH, it should be understood that any other wireless technology may be used for wireless communications between the hearing device 1000 and external device 1010.

In an embodiment, hearing device 1000 may include a transceiver configured to send and receive wireless communications ("data"). This data may be, for example, information for controlling the hearing device 1000 or displaying information regarding the hearing device 1000 to the recipient using the external device 1010. Or, for example, this data may be audible information (e.g., music) that the recipient desires to listen to. If the data is audible information from the external device 1010, referring back to FIG. 2 the data may be from the transceiver to the signal processor 240, in a similar manner as data is transferred from the microphones to the signal processor. Then, as described above, the signal processor uses one or more of a plurality of techniques to selectively process, amplify and/or filter the signal to generate a processed signal.

The hearing device may be designed so that the interface of the device is customized depending on the preferences of the patient. For example, recipients may use software that allows the display screen to display a series or grouping of virtual buttons that appear on a touch screen that are configured in any suitable manner. Such buttons can be configured to mimic existing music players, mobile phones or other electronic devices or may be configured in any combination desired.

Figure 11:
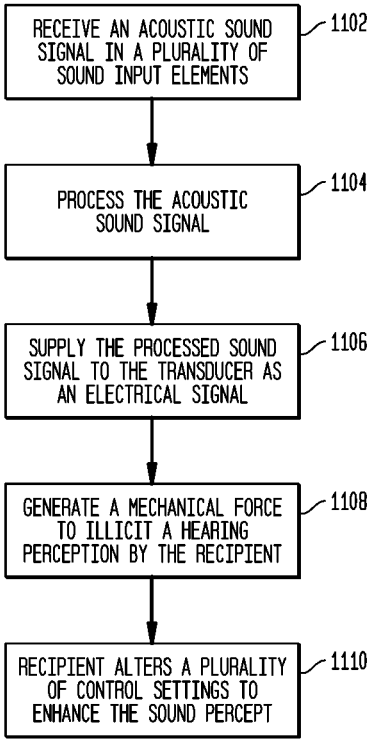
FIG. 11 is a flowchart illustrating the conversion of an input sound into skull vibration in accordance with embodiments of the present invention.

FIG. 11 illustrates the conversion of an input sound signal into a mechanical force for delivery to the recipient's skull and the recipient's ability to adjust the control settings thereof, in accordance with embodiments of bone conduction device 300. At block 1102, bone conduction device 300 receives an sound signal. In certain embodiments, the sound signal is received via microphones 302. In other embodiments, the input sound is received via an electrical input. In still other embodiments, a telecoil integrated in, or connected to, bone conduction device 300 may be used to receive the sound signal.

At block 1104, the sound signal received by bone conduction device 300 is processed by the speech processor in electronics module 304. The speech processor may be similar to speech processors used in acoustic hearing aids. In such embodiments, speech processor may selectively amplify, filter and/or modify sound signal. For example, speech processor may be used to eliminate background or other unwanted noise signals received by bone conduction device 300.

At block 1106, the processed sound signal is provided to transducer 306 as an electrical signal. At block 1108, transducer 306 converts the electrical signal into a mechanical force configured to be delivered to the recipient's skull via anchor system 308 so as to illicit a hearing perception of the sound signal.

At block 1110, the recipient, through the user interface, alters a plurality of control settings to enhance the sound percept.

Although the above description was discussed with reference to the recipient using the hearing device, it should be understood that this was provided for explanatory purposes and the hearing device and its user interface may be used in a similar manner by any user (e.g., doctor, family member, friend, or any other person).

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there from.

What is claimed is:

1. A bone conductive device for enhancing the hearing of a recipient, the bone conduction device comprising:

a sound input device configured to receive sound signals and generate a plurality of signal representative of the signals;

an electronics module configured to receive said plurality of signal and having a first control setting configured to control a first characteristic of at least one of said plurality of signals;

a vibrator configured to receive said plurality of signal representative of the sound signal and transmit vibrations to the recipient's bone;

a memory unit configured to store data including menu-driven data having a menu-driven organization;

a user interface configured to display at least a portion of the menu-driven data, the user interface having a first interface control configured to interface with said first control setting and alter said first characteristic by navigation of the menu-driven data;

a housing; and a display screen configured to display the status of the first control setting, wherein the display screen is mounted to the housing.

2. The bone conductive device of claim 1, wherein the user interface is a touch screen configured to accept user input.

3. The bone conductive device of claim 1, wherein said bone conductive device is configured to wirelessly communicate with an external device.

4. The bone conductive device of claim 1, wherein at least some of said menu-driven data in the memory unit is configured to be displayed on said screen.

5. The bone conductive device of claim 1, further comprising a mobile communications device configured to transmit and receive at least one voice communications and data communications.

6. The bone conductive device of claim 5, further comprising a display screen configured to display information related to said at least one voice communications and data communications.

7. The bone conductive device of claim 5, wherein saaid at least one voice communications and data communications are configured to be transmitted to the recipient's bone.

8. A bone conduction device for enhancing the hearing of a recipient, the bone conduction device comprising:

a sound input device configured to receive sound signals and generate a plurality of signals representative of the sound signals;

an electronics module configured to receive said plurality of signals and having a first control setting configured to control a first characteristic of at least one of said plurality of signals;

a vibrator configured to receive said plurality of signals representative of the sound signals and transmit vibrations to the recipient's bone;

a user interface having a first interface control configured to interface with said first control setting and alter said first characteristic;

a housing; and a retention system arranged to releasably dispose the housing adjacent to the recipient's skull, wherein the recipient interfaces with the first control setting through movement of the housing relative to the retention system and the skull.

9. A bone conductive device for enhancing the hearing of a recipient, the bone conductive device comprising:

a sound input device configured to receive sound signals;

a memory unit configured to store data including menu-driven having a menu-driven organization;

a user interface configured to allow the recipient to access said menu-driven data;

a display screen configured to display at least a portion of said menu-driven data; and a housing, wherein:

the bone conduction device is a percutaneous bone conduction device including a coupling configured to couple to an implantable abutment attached to a recipient's skull;

the display screen and the sound input device are mounted to the housing; and the user interface includes a device configured to permit the recipient to access said menu-driven data through movement of the housing relative to the coupling.

10. The bone conduction device of claim 9, wherein the display screen is a touch screen configured to accept user input.

11. The bone conduction device of claim 9, wherein said display screen is configured to display at least one scrolling menu.

12. The bone conduction device of claim 9, wherein said bone conduction device is to wirelessly communicate with an external device.

13. The bone conduction device of claim 9, wherein said menu-driven data is stored in said memory unit as a compressed audio file.

14. The bone conduction device of claim 9, further comprising a mobile communications device configured to transmit and receive at least one of voice communications and data communications.

15. The bone conduction device of claim 14, wherein said display screen is configured to display information related to said at least one of voice communications and data communications.

16. The bone conduction device of claim 14, wherein said at least one of voice communications and data communications are configured to be transmitted to the recipient's bone.

17. The bone conduction device of claim 1, wherein:

the first control setting includes at least one of amplification control, maximum power output control, noise reduction control, speech enhancement control, and frequency damping control.

18. The bone conduction device of claim 1, wherein:

the electronics module is further configured to have a second control setting configured to control a second characteristic of said at least one of said plurality of signals;

the memory unit is further configured to store second data having a menu-driven organization; and the user interface is further configured to interface with said second control setting and alter said second characteristic by navigation of the menu-driven second data.

19. The bone conduction device of claim 1, wherein:

the menu-driven organization of the menu-driven data stored in the memory unit includes a plurality of menus; and the user interface is further configured to alter said first characteristic by at least one of:

selection of a desired menu from amongst the plurality thereof; and navigation within the contents of a given one of the plurality of menus.

20. The bone conductive device of claim 8, wherein the bone conductive device is a percutaneous bone conductive device;

and the retention system includes:

an abutment; and a coupling device configured to engage the abutment; wherein the recipient interface with the first control setting through movement of the housing relative to the abutment.

21. The bone conduction device of claim 8, wherein:

the housing is oriented along a reference axis substantially normal to a plane substantially corresponding to a surface of the skull.

22. The bone conduction device of claim 21, wherein:

the recipient interfaces with the first control setting through movement of the housing relative to the plane and the reference axis.

23. The bone conduction device of claim 21, wherein:

the recipient interfaces with the first control setting through movement of the housing rotationally about the reference axis.

24. The bone conduction device of claim 21, wherein:

the recipient interfaces with the first control setting through movement of the housing along the reference axis.

* * * * *

UNITED STATES PATENT AND TRADEMARK OFFICE

CERTIFICATE OF CORRECTION

PATENT NO. : 8,737,649 B2
APPLICATION NO. : 12/355380
DATED : May 27, 2014
INVENTOR(S) : Parker et al.

It is certified that error appears in the above-identified patent and that said Letters Patent is hereby corrected as shown below:

In Column 14, line 22, change "conductive" to --conduction--

In Column 14, line 25, change "signal" to --signals--

In Column 14, line 26, before "signals" insert --sound--

In Column 14, line 28, change "signal" to --signals--

In Column 14, line 45, change "conductive" to --conduction--

In Column 14, line 48, change "conductive" to --conduction--

In Column 14, line 51, change "conductive" to --conduction--

In Column 14, line 53, after "said" insert --display--

In Column 14, line 54, change "conductive" to --conduction--

In Column 14, line 57, after "one" insert --of--

In Column 14, line 59, change "conductive" to --conduction--

In Column 14, line 62, after "one" insert --of--

In Column 14, line 64, change "conductive" to --conduction--

In Column 14, line 65, change "ssaid" to --said--

In Column 14, line 65, after "one" insert --of--

In Column 15, line 22, change "conductive" to --conduction--

In Column 15, line 23, change "conductive" to --conduction--

Signed and Sealed this
Ninth Day of August, 2016

Michelle K. Lee

Michelle K. Lee
*Director of the United States Patent and Trademark Office*

In Column 15, line 26, after “driven” insert --data--

In Column 16, line 33, change “conductive” to --conduction--

In Column 16, line 34, change “conductive” to --conduction--

In Column 16, line 39, change “interface” to --interfaces--